US007040700B2

(12) United States Patent
Duncan et al.

(10) Patent No.: US 7,040,700 B2
(45) Date of Patent: May 9, 2006

(54) SOFA AND METHOD OF MANUFACTURING SAME

(75) Inventors: Bob Duncan, Irving, TX (US); Doug Gasal, Dallas, TX (US); Henry Panceri, Grand Prairie, TX (US); Kevin Nguyen, Dallas, TX (US)

(73) Assignee: American Leather, Dallas, TX (US)

( * ) Notice: Subject to any disclaimer, the term of this patent is extended or adjusted under 35 U.S.C. 154(b) by 0 days.

(21) Appl. No.: 10/726,820

(22) Filed: Dec. 2, 2003

(65) Prior Publication Data

US 2005/0017553 A1 Jan. 27, 2005

Related U.S. Application Data

(60) Provisional application No. 60/490,387, filed on Jul. 25, 2003.

(51) Int. Cl.
*A47C 31/02* (2006.01)

(52) U.S. Cl. ..... 297/218.4; 297/218.1; 297/229

(58) Field of Classification Search ..... 297/218.1, 297/218.2–218.5, 228.13, 226, 225, 228, 297/440.11, 229; 5/402, 403, 409
See application file for complete search history.

(56) References Cited

U.S. PATENT DOCUMENTS 3,104,913 A * 9/1963 Clay et al. ..... 297/218.3
3,179,469 A * 4/1965 Heuston ..... 297/452.56
3,589,770 A * 6/1971 Kelley ..... 297/218.5
3,608,959 A * 9/1971 Sarvas ..... 297/218.3
3,695,690 A * 10/1972 Carson ..... 297/218.3
3,844,612 A * 10/1974 Borggren et al. ..... 297/451.3
5,320,407 A * 6/1994 Tell ..... 297/228.11
5,626,388 A * 5/1997 Haltner ..... 297/228.11
5,681,090 A * 10/1997 St. Thomas ..... 297/440.14
5,826,939 A * 10/1998 Beyer ..... 297/218.3
6,089,657 A * 7/2000 Banno et al. ..... 297/218.1
6,116,685 A * 9/2000 White et al. ..... 297/218.1
6,293,624 B1 * 9/2001 Gaylord et al. ..... 297/440.11
6,709,054 B1 * 3/2004 Riley et al. ..... 297/228
6,796,609 B1 * 9/2004 Illulian ..... 297/218.1

FOREIGN PATENT DOCUMENTS

DE 3513076 A1 * 10/1986
EP 645108 A2 * 3/1995
GB 2150021 A * 6/1985
WO WO 9015556 A * 12/1990

* cited by examiner

*Primary Examiner*—Peter R. Brown
(74) *Attorney, Agent, or Firm*—Myers Bigel Sibley & Sajovec

(57) ABSTRACT

A backrest and deck subassembly for a sofa includes: a frame having a generally horizontal deck section, the deck section including a top portion and an underlying bottom portion, the frame also having a generally upright backrest section attached to and extending upwardly from the deck section; and an integrated upholstery piece that covers the deck and backrest portions of the frame and underlies the bottom section of the deck portion. The integrated upholstery piece can reduce manufacturing time by eliminating the need to separately attach the upholstery and dust cover. In some embodiments, the upholstery piece includes a zipper that can markedly facilitate enclosing of the frame within the upholstery piece.

14 Claims, 14 Drawing Sheets

SOFA AND METHOD OF MANUFACTURING SAME

CROSS-REFERENCE TO RELATED APPLICATION

The present application claims priority from U.S. Provisional Patent Application Ser. No. 60/490,387, filed 25 Jul. 2003, the disclosure of which is hereby incorporated herein in its entirety.

FIELD OF THE INVENTION

The present invention relates generally to furniture, and more particularly to seating units and their methods of manufacture.

BACKGROUND OF THE INVENTION

A typical sofa includes a deck or seating surface for supporting a seated occupant, a backrest that is attached to the rear edge of the deck and rises upwardly therefrom, and arms attached to the lateral edges of the deck. Conventionally, an upholstered sofa is constructed by first forming an internal frame (usually made of wood) that provides the general shape of the sofa. The frame includes the underlying portions of the deck, backrest, and arms. In some instances inserts (typically formed of a soft foam) will be attached to the wooden frame. A deck fabric is stretched across the deck to provide support for seating, and in some instances, springs or other resilient members will be positioned below the deck fabric. This frame is then covered with upholstery that is typically tacked or stapled to the frame, with separate pieces of upholstery being attached for each arm and for the back and deck. Many sofas will also include a separate dust cover that covers the underside of the deck and is stapled or tacked to the frame. Subsequently, additional features such as feet, adornments and the like are attached to the upholstered sofa. Finally, cushions are typically added to cover the backrest and deck; these cushions may be removable or permanently attached.

Although the foregoing represents a conventional manufacturing technique, there are some shortcomings. Stapling the deck fabric, upholstery and/or dust cover into place can be relatively time-consuming, thereby increasing labor costs. Also, the attachment of the arm upholstery can be somewhat burdensome, particularly at the joints between the arms and the back and deck. Further, if the upholstery is a relatively thick material, such as leather, the presence of seams and folds in the upholstery may render the attachment of the feet and other ornamental features difficult. As such, alternative techniques for manufacturing sofas may be desirable.

SUMMARY OF THE INVENTION

The present invention is directed to subassemblies and manufacturing methods for sofas that can improve manufacturing efficiency and product quality. As a first aspect, embodiments of the present invention are directed to a backrest and deck subassembly for a sofa. The subassembly comprises: a frame having a generally horizontal deck section, the deck section including a top portion and an underlying bottom portion, the frame also having a generally upright backrest section attached to and extending upwardly from the deck section; and an integrated upholstery piece that covers the deck and backrest portions of the frame and underlies the bottom section of the deck portion. The integrated upholstery piece can reduce manufacturing time by eliminating the need to separately attach the upholstery and dust cover. In some embodiments, the upholstery piece includes a zipper that can markedly facilitate enclosing of the frame within the upholstery piece.

As a second aspect, embodiments of the present invention are directed to another backrest and deck subassembly for a sofa. In these embodiments, the subassembly comprises: a frame having a generally horizontal deck section, the deck section including a top portion, the frame also having a generally upright backrest section attached to and extending upwardly from the deck section, the deck section top portion having front and rear laterally-extending slots; a deck fabric sheet; and a pair of slats attached to the deck fabric sheet, the slats being received in the front and rear slots of the deck section top portion. This configuration can simplify and expedite installation of a deck fabric over the deck section, and can do so while producing a taut deck fabric. Embodiments of this aspect of the invention may also include those in which the deck fabric sheet is attached to an upholstery piece (like that discussed above) that substantially covers the frame.

As a third aspect, embodiments of the present invention are directed to a sofa, comprising: a backrest and deck subassembly comprising a frame having a deck section and a backrest section, the frame including lateral surfaces with inwardly-extending recesses; and a pair of arm units, each of the arm units including hooks configured to fit within the recesses of the frame to connect the arm units thereto. This configuration enables the back and deck subassembly and the arm units to be constructed and upholstered separately, then brought together to form the final sofa unit.

As a fourth aspect, embodiments of the present invention are directed to an arm unit for a sofa, comprising: a frame having a bottom surface, the bottom surface having front and rear recesses; an upholstery piece that covers the frame bottom surface; and front and rear feet that are attached to the upholstery piece to underlie the front and rear recesses. The presence of the recesses can enable the feet to be placed precisely. In some embodiments, seam channels are present in the recesses to receive seams from the upholstery and improve mounting of the feet.

As a fifth aspect, embodiments of the present invention are directed to a method of constructing a sofa. The method comprises the steps of: applying a unitary back-deck upholstery piece to a back-deck frame of a sofa, the upholstery piece substantially enclosing the back-deck frame, to form an upholstered back-deck unit; applying a respective unitary arm upholstery piece to each of two arm frames, the upholstery pieces substantially enclosing the arm frames, to form upholstered arm units; and attaching the upholstered arm units to the upholstered back-deck unit to form a fully upholstered sofa. In some embodiments, it may be advantageous for the back-deck and arm units to incorporate aspects of embodiments of the invention discussed above.

DETAILED DESCRIPTION OF EMBODIMENTS OF THE INVENTION

The present invention will be described more particularly hereinafter with reference to the accompanying drawings. The invention is not intended to be limited to the illustrated embodiments; rather, these embodiments are intended to fully and completely disclose the invention to those skilled in this art. Like numbers refer to like components throughout, and certain dimensions and thicknesses may be exaggerated for clarity. It will be understood that when an element is referred to as being "attached", "connected" or "coupled" to another element, it can be directly connected or coupled to the other element or intervening elements may be present. In contrast, when an element is referred to as being "directly attached," "directly connected" or "directly coupled" to another element, there are no intervening elements present.

The present invention is directed to a sofa having a seat and backrest that form a seat-back deck unit and arms attached on either end thereof. As used herein, the terms "forward", "front" and derivatives thereof refer to the direction defined by a vector extending from the backrest toward the seat parallel to the underlying surface. Conversely, the terms "rearward" and derivatives thereof refer to the direction directly opposite the forward direction; i.e., the rearward direction is defined by a vector that extends from the seat toward the backrest parallel to the underlying surface. The forward and rearward directions together comprise the "longitudinal" directions relative to the sofa. The terms "outward," "lateral", and derivatives thereof refer to the direction defined by a vector originating in the center of the seat and extending toward the arms in the plane of the underlying surface and perpendicular to the forward and rearward directions. The terms "inboard", "inward" and derivatives thereof refer to the direction directly opposite to the lateral direction as defined hereinabove. The outward and inward directions together comprise the "transverse" directions relative to the chair.

Figure 1:
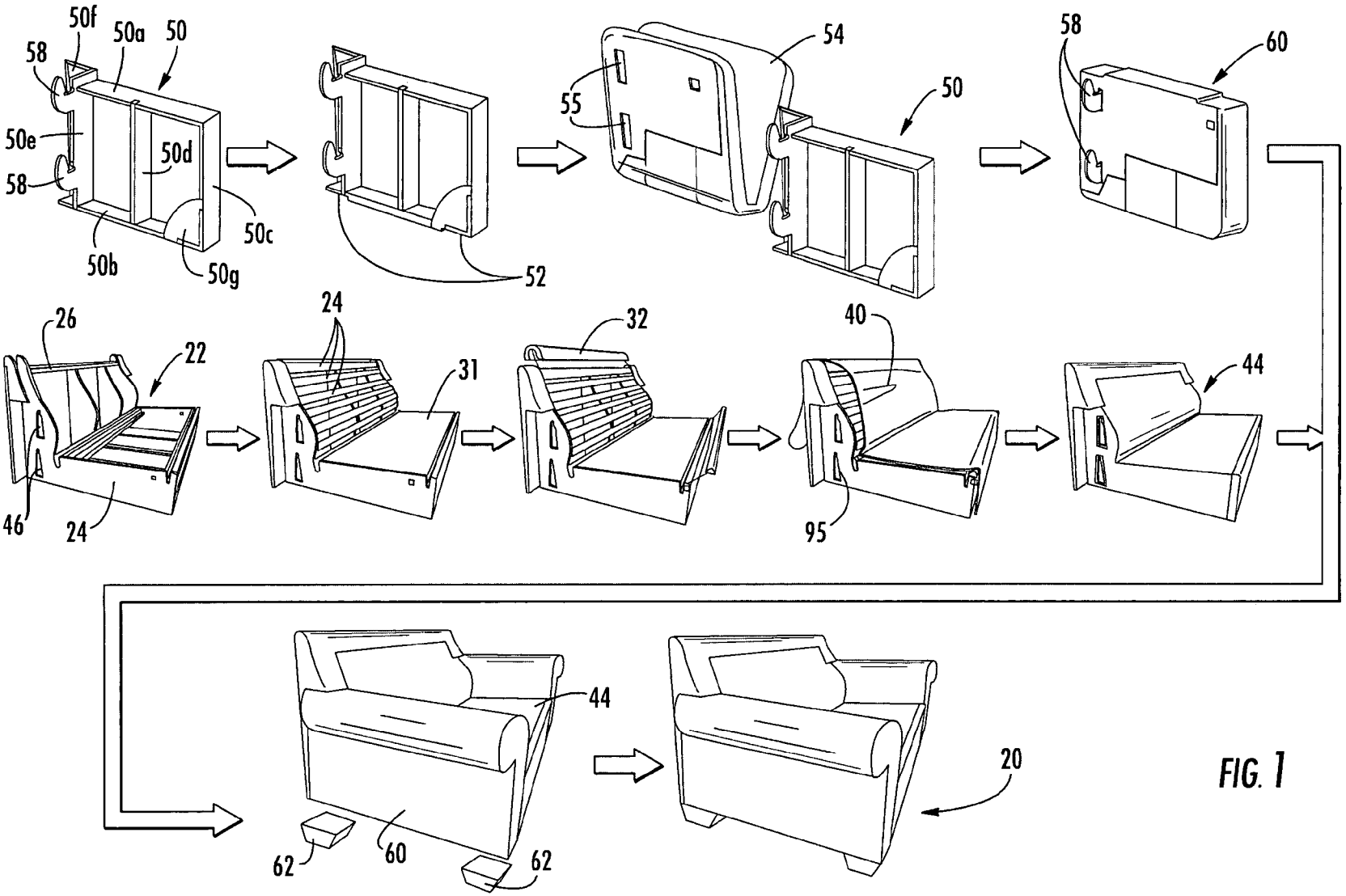
FIG. 1 is a schematic diagram illustrating an embodiment of a method of constructing a sofa according to the present invention.

Referring now to the figures, a method of constructing a sofa (designated broadly at 20) is illustrated in FIG. 1. In general terms, the sofa 20 is constructed based on two independent manufacturing paths that produce subassemblies that then are combined into the final sofa product. In the first path, two upholstered arm units 60 are produced. Each arm unit 60 begins with a skeletal frame 50 having two protruding hooks 58. As a first step, recesses 52 are formed in the bottom plank of the arm frame 50. The arm frame 50 is then substantially enclosed within a single arm upholstery piece 54. The upholstery piece 54 includes windows 55 on an inwardly-facing surface through which the hooks 58 protrude. This process produces two upholstered arm units 60.

In the second manufacturing path, a skeletal back-deck frame 22 with deck and back sections 24, 26 is employed (the deck section 24 is the portion of the frame 22 that provides support for a seated occupant). An insert cap 32 that fits onto the top of the back section 26 is attached. A single back-deck upholstery piece 40 is then applied to the back-deck frame 22 such that it substantially encloses the back-deck frame 22 to form an upholstered back-deck unit 44.

At this point the two manufacturing paths merge, as the upholstered arm units 60 are attached to the upholstered back-deck unit 44. The hooks 58 of the arm units 60 are placed within receptacles 46 in the lateral edges of the upholstered back-deck 44 (access to the receptacles 46 is available due to the presence of windows 95 in the upholstery piece 40). The arm units 60 are further secured to the back-deck unit 44 with threaded fasteners to produce the sofa 20. Finally, feet 62 are mounted under the recesses 52 and the portions of the upholstery piece 54 that underlie them.

The above-described steps and materials are described in greater detail below, with reference to the remaining figures.

Figure 2:
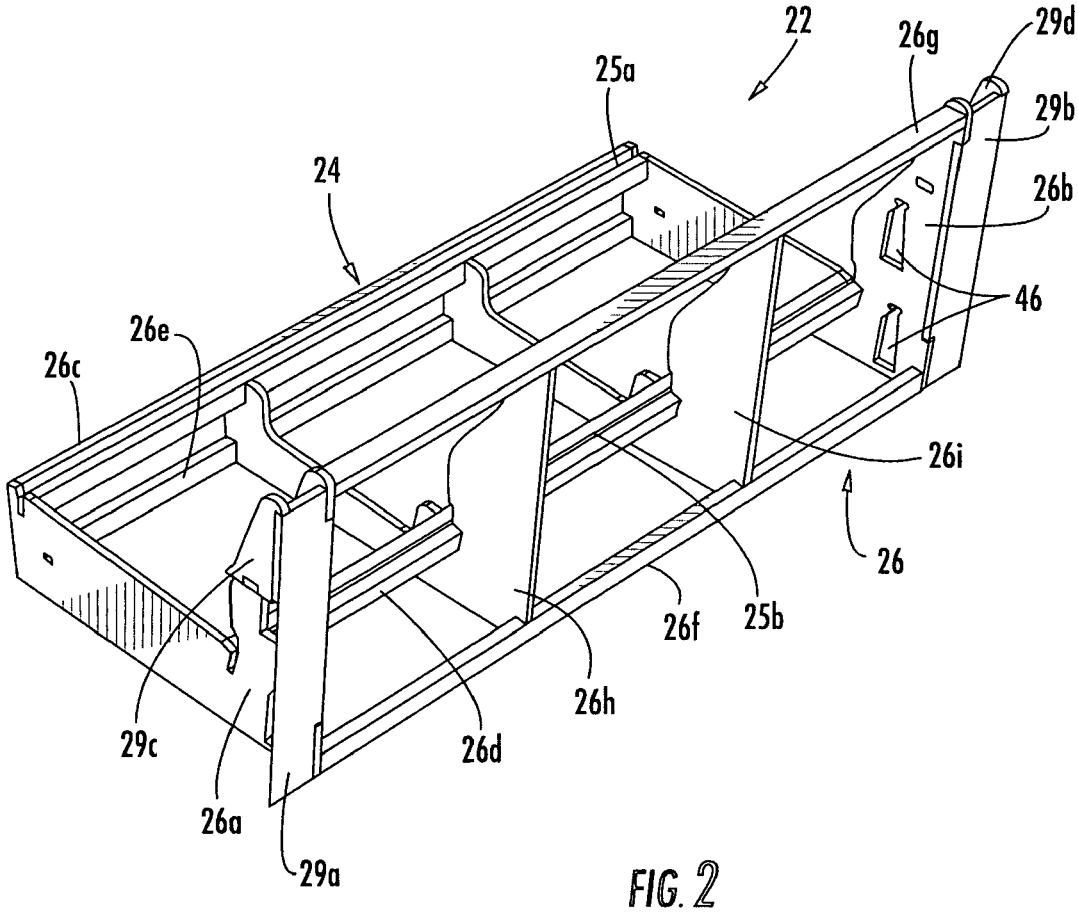
FIG. 2 is a rear perspective view of the back-deck frame of the sofa of FIG. 1 without backrest straps and a deck suspension unit.

FIG. 2 illustrates the back-deck frame 22, which, as noted above, includes a deck section 24 and a back section 26. The frame 22 as illustrated is formed of a number of wooden planks and boards that are fixed to one another define the outline of a sofa. Side boards 26*a*, 26*b* form the sides of the frame 22; the side boards 26*a*, 26*b* include receptacles 46 that are generally vertically aligned. Front and rear rails 26*c*, 26*d* span the front and rear portions of the side boards 26*a*, 26*b* to define the surface of the deck section 24. A lower front rail 26*e* spans the lower front corners of the side boards 26*a*, 26*b*, and a lower rear rail 26*f* spans the lower rear corners of the side boards 26*a*, 26*b*. A top rail 26*g* spans the top rear portion of the side boards 26*a*, 26*b*. Internal support boards 26*h*, 26*i* are positioned intermediate of the side boards 26*a*, 26*b* to support the aforementioned rails. Flanges 29*a*, 29*b* are attached to and extend laterally from the rear edges of the side boards 26*a*, 26*b*. Ears 29*c*, 29*d* are mounted to the upper lateral edges of the flanges 29*a*, 29*b*. The gap between the ears 29*c*, 29*d* and their adjacent side boards 26*a*, 26*b* may be covered with chip board, masonite or some other material.

Horizontal straps 28 (typically formed of a flexible fabric—see FIG. 1) extend between the side boards 26*a*, 26*b* of the frame 22 to define the forward surface of the back section 26. A deck suspension unit 31 (for example, sinuous or coil springs, webbing sheets or straps, or the like—see FIG. 1) spans the area between the side boards 26*a*, 26*b* and the front and rear rails 26*c*, 26*d* to define further the upper surface of the deck section 24. A transversely-extending front slot 25*a* is present in the front rail 26*c*, and a similar transversely-extending rear slot 25*b* is present in the rear rail 26*d* (see FIG. 2). The front and rear slots 25*a*, 25*b* are configured such that they have open upper ends that flare outwardly from one another (i.e., the upper end of the slot 25*a* faces slightly forwardly and the upper end of the slot 25*b* faces slightly rearwardly—best seen in FIG. 6).

Those skilled in this art will appreciate that the frame 22 can take many forms other than that illustrated and described herein. For example, the frame 22 may be constructed of different materials, may have additional or fewer rails than those shown herein, or may lack the slots and receptacles discussed above. As another example, the deck suspension unit 31 may be omitted entirely. Other variations will also be apparent to those skilled in this art and need not be described in detail herein.

Figure 3:
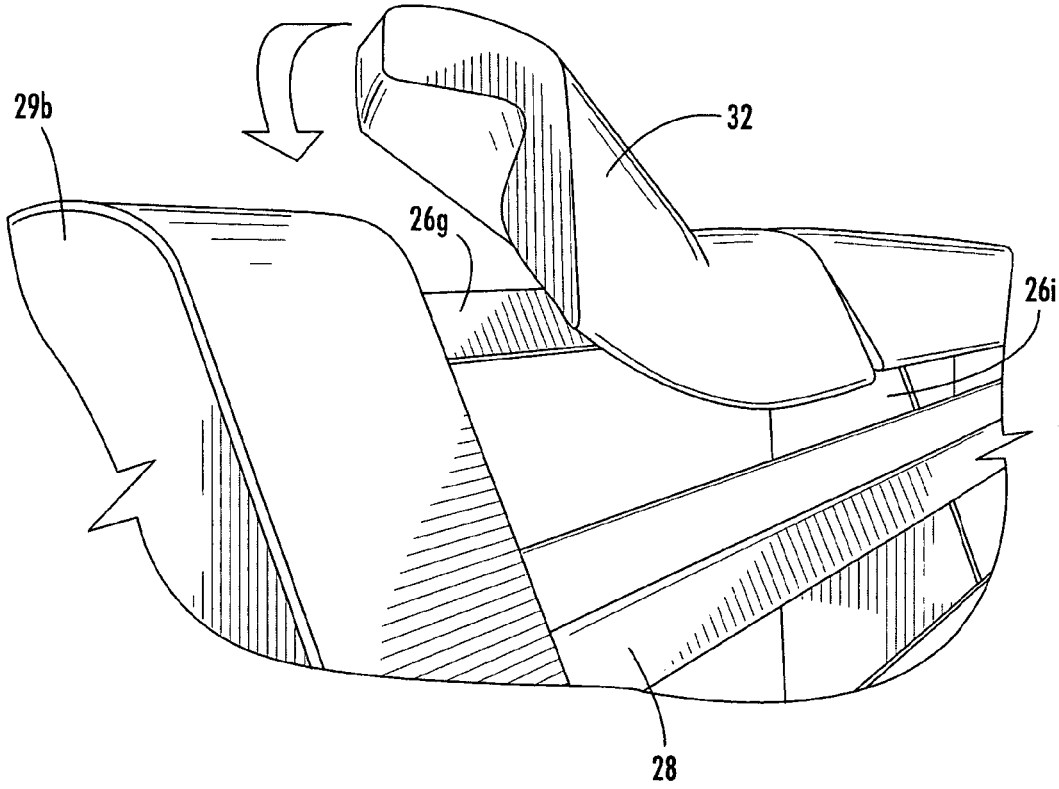
FIG. 3 is an enlarged front perspective view of the back-deck frame of FIG. 2 with a top edge insert cap being installed.

Referring now to FIG. 3, the installation of the top edge insert cap 32 is illustrated therein. As can be seen in FIG. 3, the top edge insert cap 32 has a substantially constant, generally L-shaped cross-section, such that the cap 32 fits over the top surface and front edge of the top rail 26*g* and provides the profile of the top portion of the sofa 20. The cap 32, which is typically formed of a flexible, expanded polyethylene foam (preferably extruded), is stapled or otherwise fastened into place on the top rail 26*g* and the internal support boards 26*h*, 26*i*. Notably, the shape of the cap 32 assists it to remain in place, and formation of the cap 32 via extrusion can reduce its cost and repeatability significantly.

Once the top edge insert cap 32 is installed, padding sheets (typically the padding sheets are formed of ¼ to 1 inch urethane foam or batted polyester fiber or similar material) are laid over the straps 28, the top edge insert cap 32 and the upper region of the rear side of the back section 26 (including the ears 29*c*, 29*d*) and stapled into place (this step is not illustrated in the drawings). Those skilled in this art will appreciate that other materials may be employed in place of the fiber sheets, and that the fiber sheets may be omitted entirely.

Referring now to FIGS. 4–8, the next step in the construction of the back-deck unit 44 is the enclosing of the back-deck frame 22 with the back-deck upholstery piece 40. This step can include multiple substeps, some of which are described below.

Figure 4:
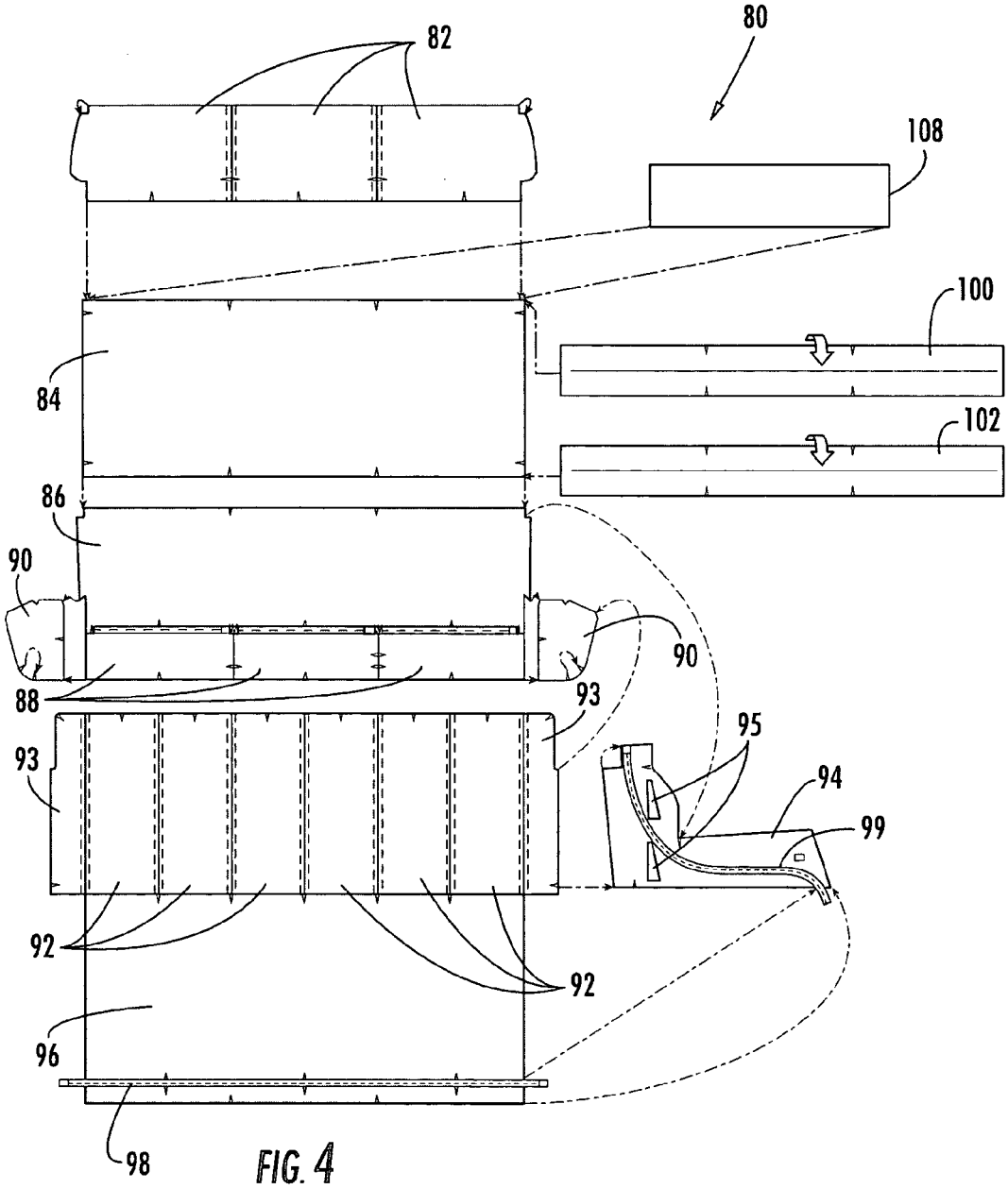
FIG. 4 is a disassembled plan view of an upholstery blank for the upholstery piece to cover the back-deck frame of FIG. 2.

Referring first to FIG. 4, the back-deck upholstery piece 40 is a single integrated piece of upholstery that is created from multiple panels that are sewn together as a back-deck upholstery blank 80 prior to installation of the upholstery piece 40 on the back-deck frame 22. The back-deck blank 80 includes a series of front panels 82 that overlie the front surface of the frame 22. A deck panel 84 shares a seam with the front panels 82 and overlies the deck surface of the frame 22. A backrest panel 86 shares a seam with the deck panel 84 and overlies the backrest surface of the frame 22. Multiple top panels 88 are sewn to the backrest panel 86 to cover the top of the back section 26 of the frame 22, and multiple back panels 92 share a seam with the top panels 88 and cover the rear surface of the back section 26 (including the flanges 29*a*, 29*b*). Two ear panels 90 are sewn to the lateral edges of the backrest panel 86 and the lateralmost top panels 88, and are also sewn to rear flange panels 93, which also share a seam with the lateralmost back panels 92. L-shaped front lateral panels 94 (only one is shown in FIG. 4) share a seam with the rear flange panels 93, and are, also sewn to the lateral edges of the backrest panel 86, the deck panel 84, and the front panels 82. A dust cover panel 96 shares a seam with the back panels 92 and an opposite seam with the lower edges of the front panels 82, and its lateralmost edges are sewn to the bottom edges of the rear and front lateral panels 93, 94.

A transversely-extending zipper 98 is included in the front region of the dust cover panel 96 and extends to the edges thereof. A zipper 99 follows a somewhat serpentine path rearwardly along the lower portion of each rear front panel 94, then veers upwardly to terminate near the top of the front lateral panel 94; in doing so, the zipper 99 passes between two windows 95 in the lateral panel 94 that are generally vertically aligned and are positioned to provide access to the receptacles 46 in the side boards 26*a*, 26*b* of the frame 22.

In the illustrated embodiment, the front panels 82, the top panels 88, the ear panels 90, and the rear flange panels 93 are formed of leather, the dust'cover panel 96 is formed of a heavy non-woven fabric, and the remaining exterior panels are formed of an air permeable non-woven fabric. Of course, these materials may vary in other embodiments of the sofa.

Those skilled in this art will recognize that other upholstery configurations may be suitable for use with the present invention. For example, different numbers and shapes of panels may be employed, or some panels that are illustrated herein may be combined or divided as desired. In addition, other reversible fasteners, such as snaps, hook-and-loop material, and the like may be employed in place of the zippers. It is preferred that the upholstery for the frame 22 be formed as a single integrated piece that is installed as a single unit.

As can be seen in FIG. 4, the upholstery blank 80 also includes a front pocket panel 100 that is folded lengthwise and sewn on the seam shared by the front panels 82 and the deck panel 84. Once sewn, the front pocket panel 100 forms a front pocket 101. A rear pocket panel 102 is folded lengthwise and sewn on the seam shared with the deck panel 84 and the backrest panel 86 to form a rear pocket 103. Preferably, the front and rear pocket panels 100, 102 are sewn simultaneously with the sewing of the aforementioned seams they share. Also, in the illustrated embodiment a padding panel 108 is sewn to the rear surface of the front panels 82 (FIG. 6) to provide cushioning and contour thereto. One or more padding sheets (not shown) may also be included beneath the deck panel 84.

Figure 5:
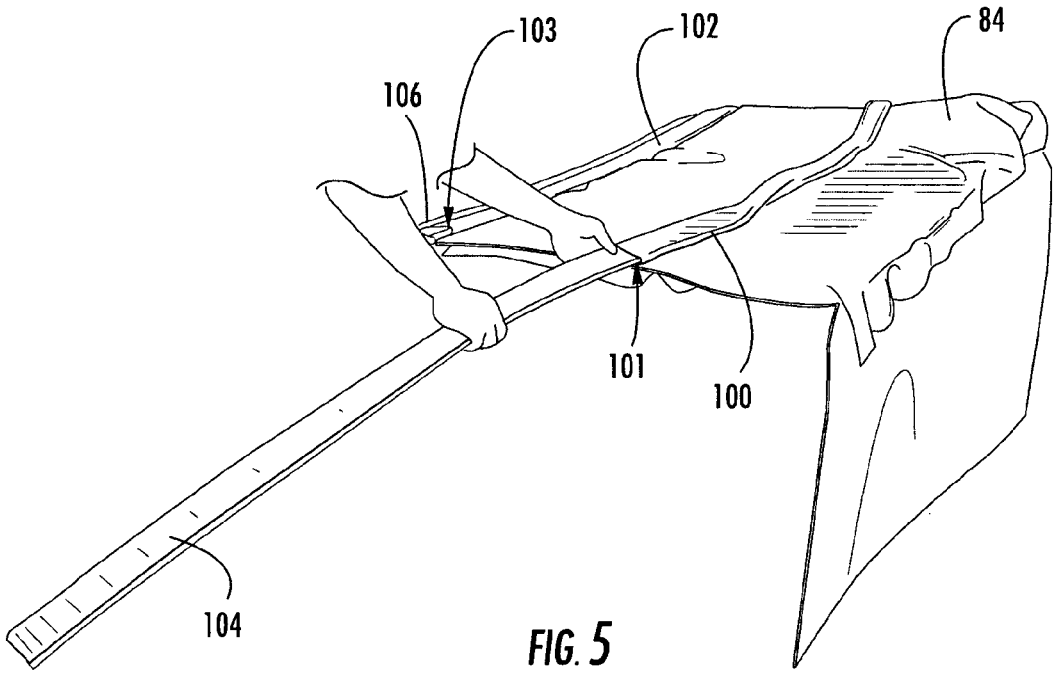
FIG. 5 is an enlarged partial perspective view of the upholstery piece of FIG. 4 illustrating insertion of slats into pockets in the upholstery piece.
Figure 6:
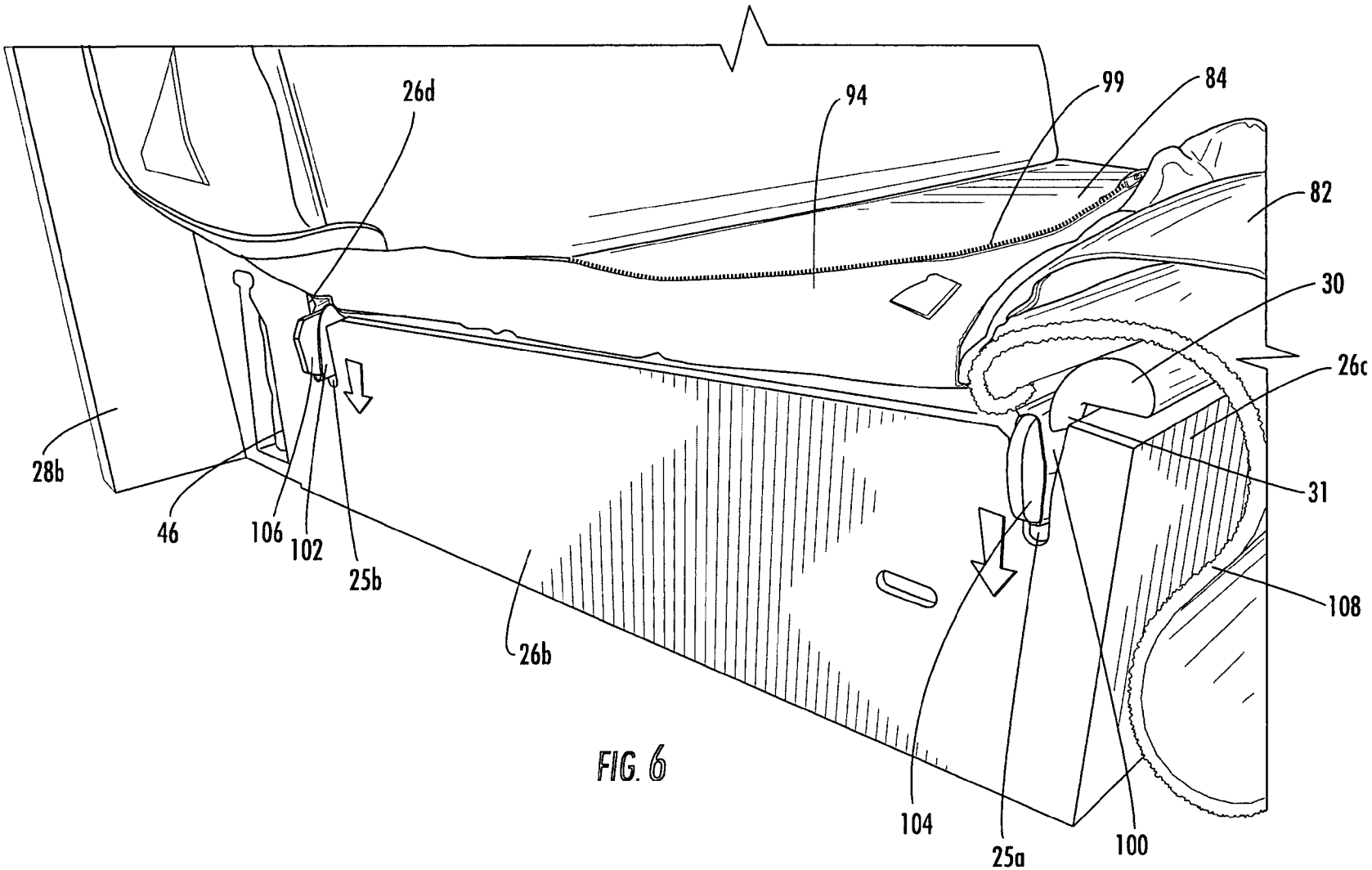
FIG. 6 is a greatly enlarged partial perspective view of the upholstery piece of FIG. 5 being installed over the back-deck unit of FIG. 2.
Figure 7:
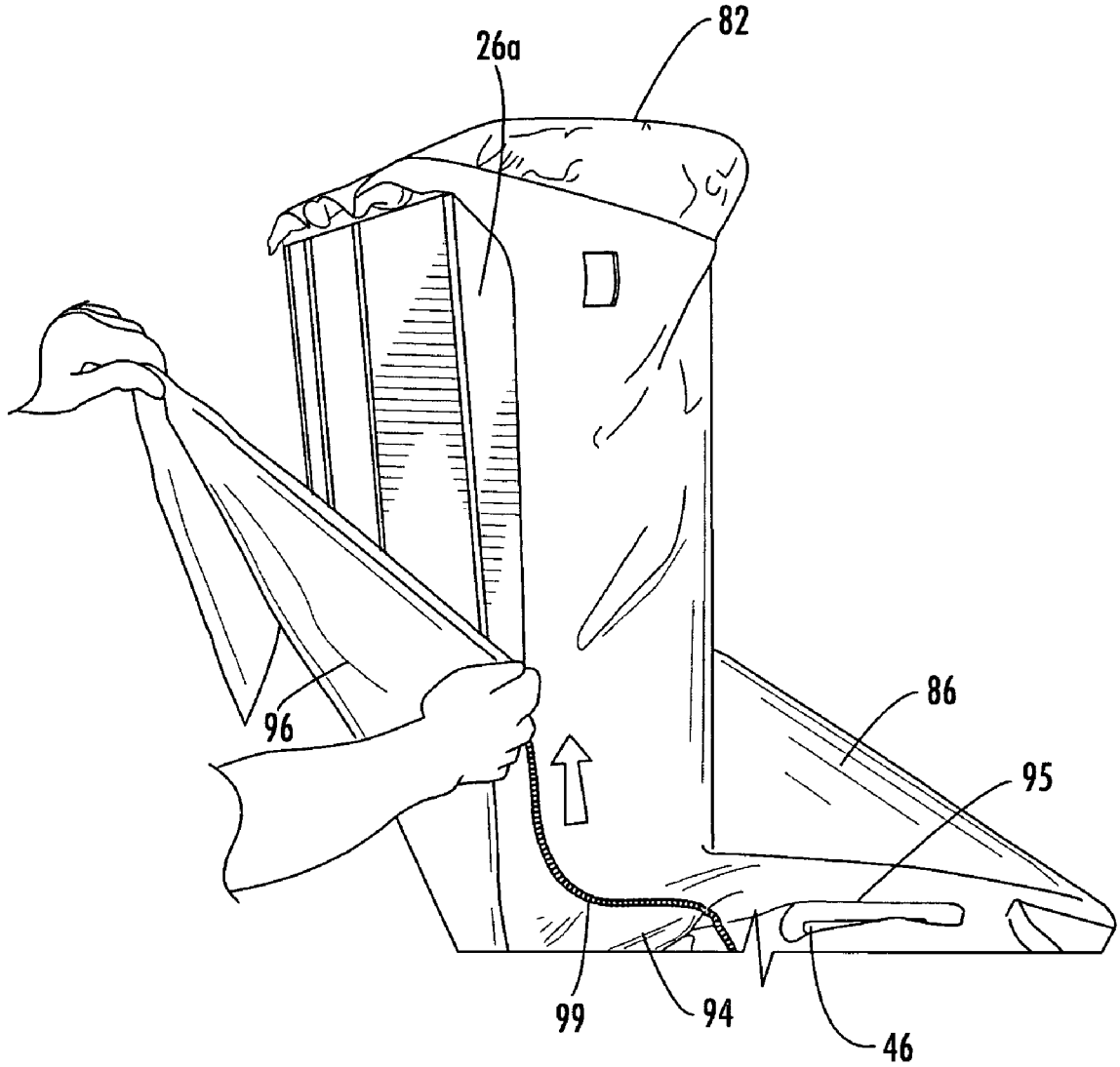
FIG. 7 is a bottom perspective view of the upholstery piece of FIG. 5 being zipped over the back-deck unit of FIG. 2.

FIGS. 5–7 illustrate the covering of the back-deck frame 22 with the upholstery piece 40. Referring first to FIG. 5, wooden slats 104, 106 are inserted into the front and rear pockets 101, 103 in the upholstery piece 40. The upholstery piece 40 is then lifted over the top of the back section 26 of the back-deck frame 22. The pocketed slats 104, 106 are then slipped into, respectively, the front and rear slots 25*a*, 25*b* of the front and rear rails 26*c*, 26*d* (FIG. 6). The orientation of the slots 25*a*, 25*b* (i.e., with their open upper ends flared away from each other) causes the deck panel 84 to be pulled taut. This step can provide a taut deck surface without substantial stapling or other securing of a deck fabric (as would typically be the case for prior sofas), thereby simplifying and expediting the installation of the deck surface.

Referring again to FIG. 6, the front edge insert cap 30 is illustrated therein. Like the top edge insert cap 32, the front edge insert cap 30 is typically formed of a flexible expanded polyethylene foam material, and is of substantially constant cross-section. The front edge insert cap 32 includes a finger 31 that extends into the front slot 25*a* in the front rail 26*c*; the remainder of the front edge insert cap 30 extends forwardly therefrom to overlie the front rail 26*c*. Once the front edge insert cap 30 has been installed, the front panels 82 of the upholstery piece 40 can be positioned over the front edge insert cap 30 and draped over the front surface of the deck section 24. The front edge insert cap 30 and the padding panel 108 may be secured to the frame 22 with staples or other fasteners.

Referring now to FIG. 7, once the front edge insert cushion 30 has been installed and the front panels 82 have been positioned, the back-deck upholstery piece 40 can be slipped over the remainder of the frame 22. After the upholstery piece 40 is secured in place with a few staples, the zippers 99 can be zipped from their upper points on the front lateral panels 94 to their termination points near the dust cover panel 96. The zipper 98 can also be zipped to complete the upholstering of the frame 22.

Figure 8:
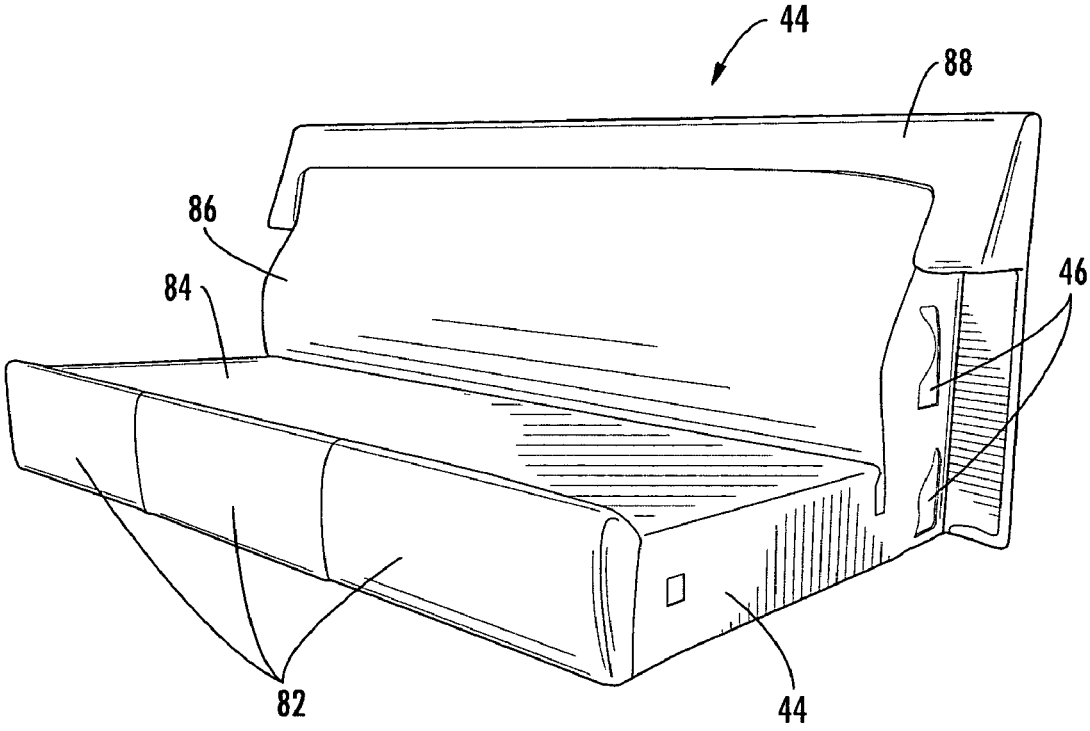
FIG. 8 is a perspective view of a fully upholstered back-deck unit of the sofa of FIG. 1.

Once the back-deck upholstery piece 40 has been installed on the frame 22, the construction of the upholstered back-deck unit 44 is complete (see FIG. 8). It can be joined with two upholstered arm units 60, the construction of one of which is described below.

Referring back to FIG. 1, the arm frame 50 includes a top plank 50*a*, a bottom plank 50*b*, and front, intermediate and rear planks 50*c*, 50*d*, 50*e* that together form a box-type skeletal frame. An external side board 50*f* is attached to the lateral edge of the rear plank 50*e* and extends rearwardly therefrom. A mounting gusset 50*g* is fixed to the inward side of the top and front planks 50*a*, 50*c*. The aforementioned hooks 58 extend inwardly and upwardly from the rear plank 50*e*.

Figure 9:
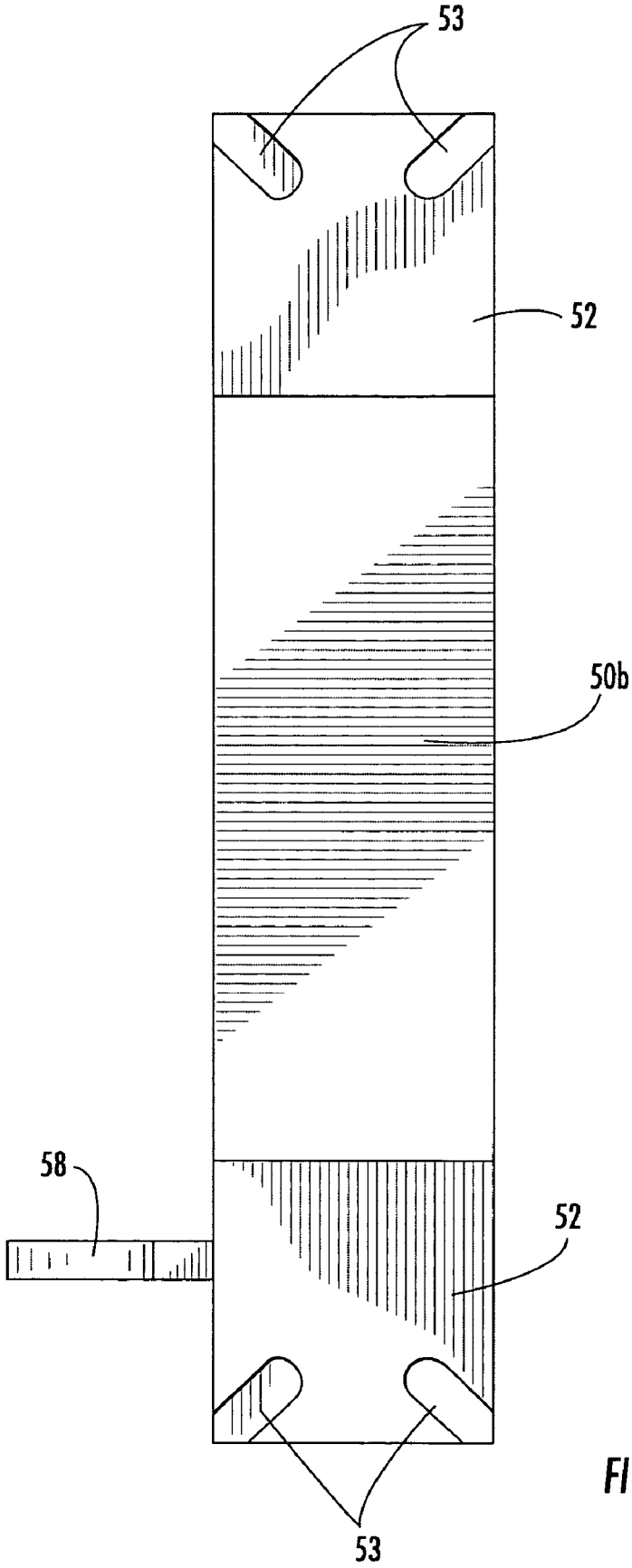
FIG. 9 is a bottom view of an arm frame of the sofa of FIG. 1 showing recesses and channels formed therein.

Referring now to FIG. 9, it should be noted that the underside of the bottom plank 50*b* includes recesses 52. The recesses 52 are typically about ⅛ inch in depth and sized to match the length and width of the feet 62. The recesses 52 may be formed in any manner known to those skilled in this art for forming such topography, including routing. Also, seam channels 53 are located at each corner of the bottom plank 50*b* and extend diagonally within the recesses 52.

Figure 10:
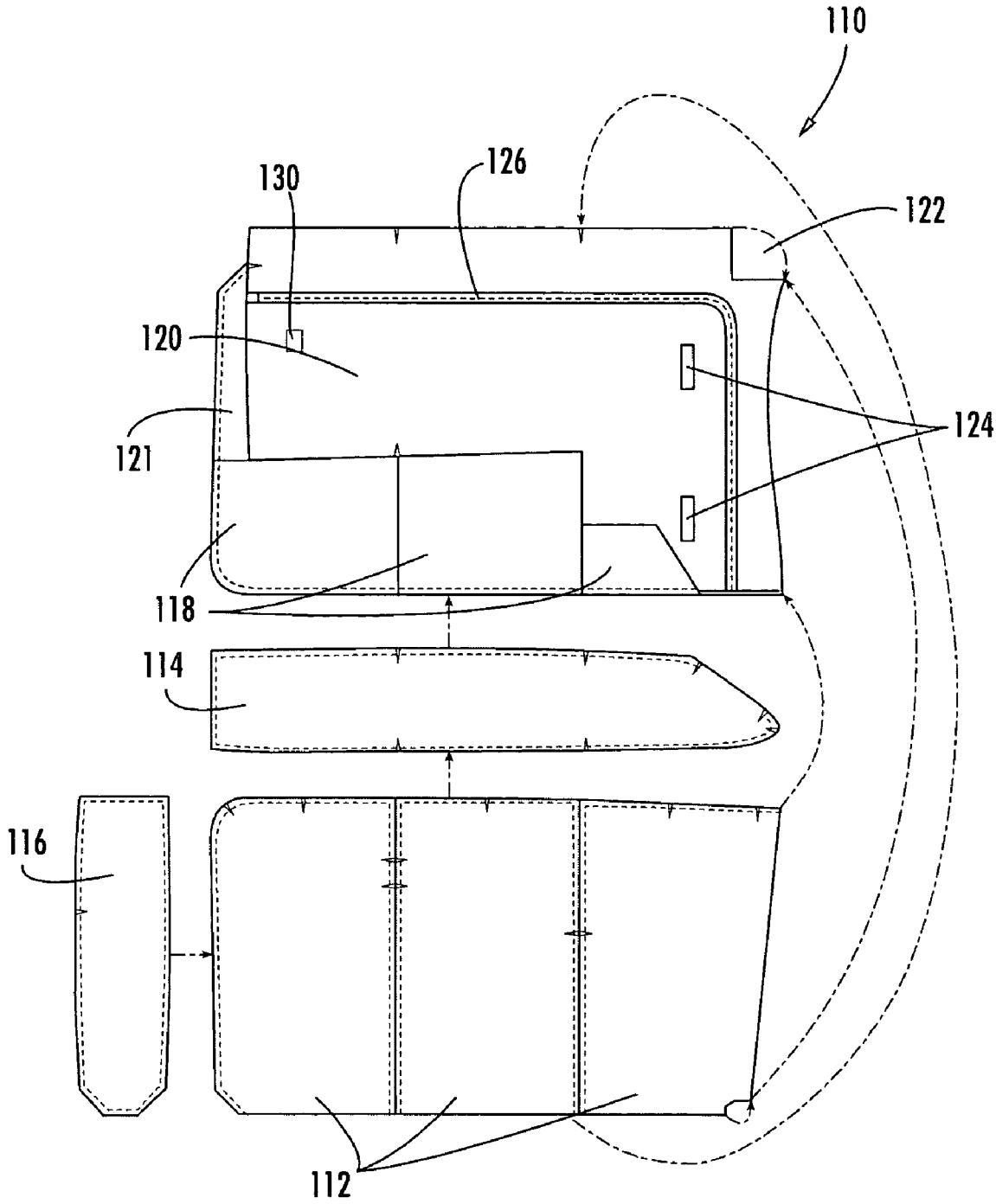
FIG. 10 is a disassembled plan view of an upholstery blank for the upholstery piece to cover the arm frame of FIG. 9.

Referring now to FIG. 10, the arm upholstery piece 54 is a single integrated unit of upholstery that is created from multiple panels that are sewn together as an arm upholstery blank 110 prior to installation of the upholstery piece 54 on the arm frame 50. The arm upholstery blank 110 includes multiple lateral panels 112, a top panel 114 that is sewn to the top edges of the lateral panels 112 and a front panel 116 that shares a seam with the top panel 114 and another seam with the forwardmost lateral panel 112. Multiple upper inner panels 118 are sewn to the inward edge of the top panel 114, and a front inner panel 121 is sewn below the front upper inner panel 118. The blank 110 is completed with a main inner panel 120 that is sewn to the upper inner panels 118 and the front inner panel 121. The main inner panel 120 includes a cutout area 122 at its lower rear corner to enable flaps formed thereby to meet and share lower and rear seams with the lateral panels 112. The main inner panel 120 also includes windows 124 that are configured and arranged to receive the hooks 58 of the arm frame 50, and a window 130 that is configured to receive a securing bolt. The main inner panel 120 further includes an L-shaped zipper 126 that commences at the top rear edge of the main inner panel 120, travels downwardly therefrom rearward of the windows 124, and extends forwardly to terminate at the front edge of the main inner panel 120.

In the illustrated embodiment, the main inner panel 120 is formed of an air permeable non-woven fabric, and the remaining panels of the upholstery piece 60 are formed of leather. However, those skilled in this art will recognize that these materials may vary as desired. Also, as is the case with the back-deck upholstery piece 40, those skilled in this art will recognize that other configurations of the upholstery piece 54 may be suitable for use with the present invention. For example, different numbers and shapes of panels may be employed, or some panels that are illustrated herein may be combined or divided as desired. In addition, other reversible fasteners, such as snaps, hook-and-loop material, and the like may be employed in place of the zippers. It is preferred that the upholstery for the frame 50 be formed as a single integrated piece that is installed as a single unit.

Figure 11:
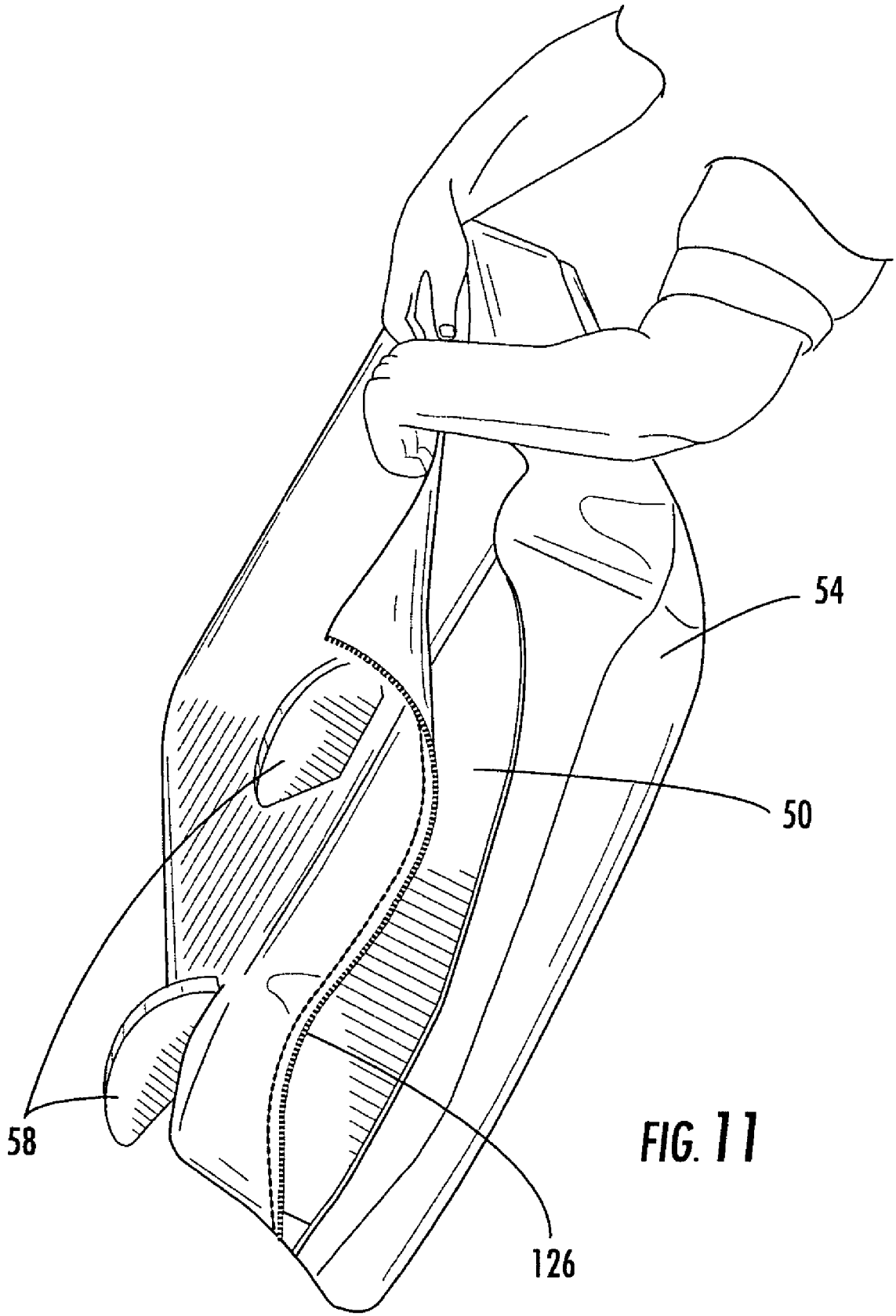
FIG. 11 is a perspective view illustrating the application of the upholstery piece of FIG. 10 over the arm frame of FIG. 9.
Figure 12:
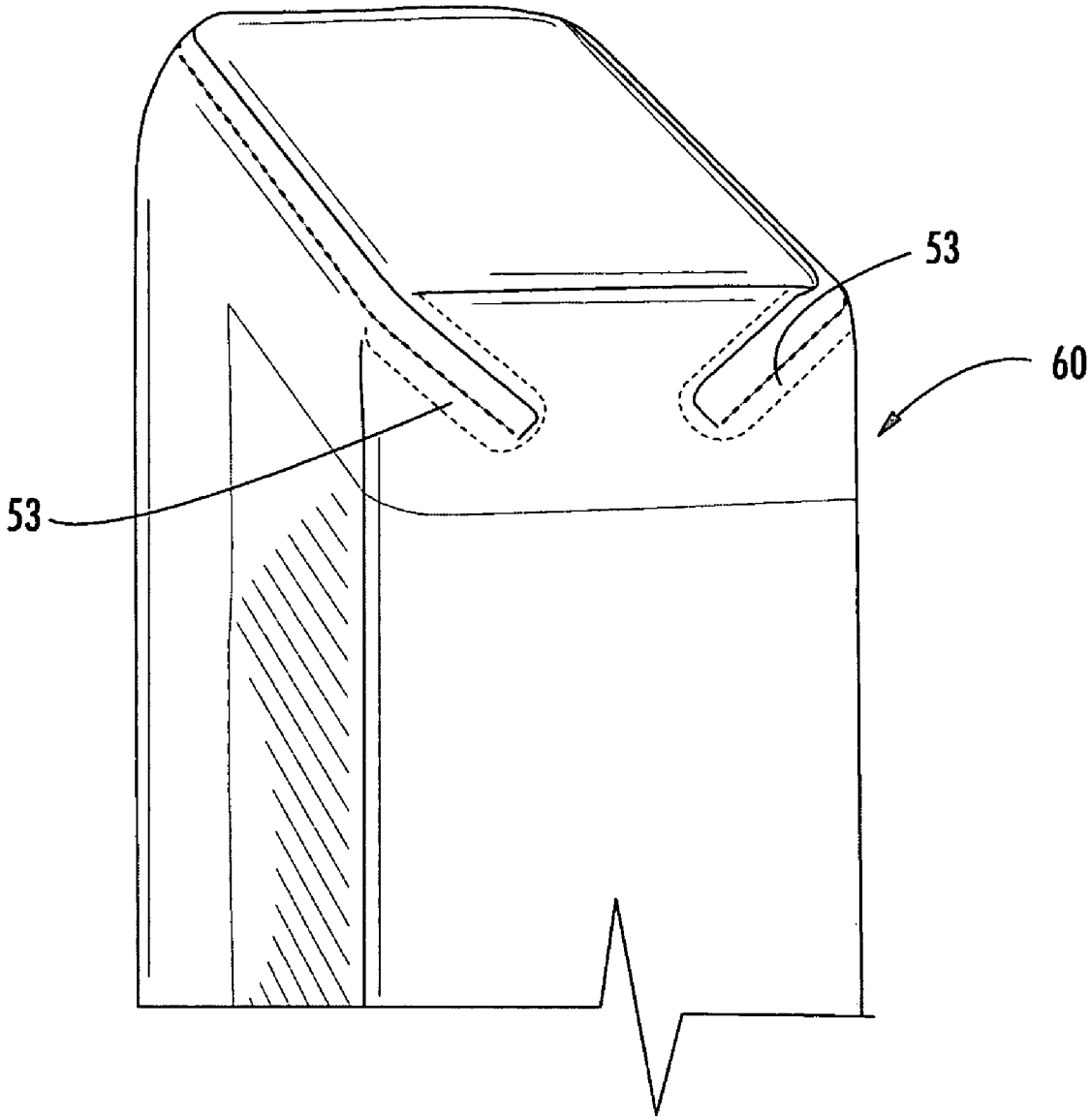
FIG. 12 is an enlarged partial bottom view of the arm frame of FIG. 9 covered with the upholstery piece of FIG. 10 showing how seams of the upholstery piece reside within the seams channels of the arm frame.

Referring now to FIG. 11, the arm upholstery piece 54 can be slipped over the arm frame 50 (for example, beginning at the lower front portion of the frame by hooking the upholstery piece 54 over the bottom plank 50*b*). In some embodiments, padding sheets or other cushioning materials are attached to portions of the arm frame 50 prior to covering the frame 50 with the upholstery piece 54. The upholstered arm unit 60 can then be completed by zipping the zipper 126 to substantially enclose the arm frame 50 with the arm upholstery piece 54 (see FIG. 12 for illustration of the upholstered arm unit 60). In the illustrated embodiment, seams from the upholstery piece 54 reside within the seam channels 53.

Figure 13:
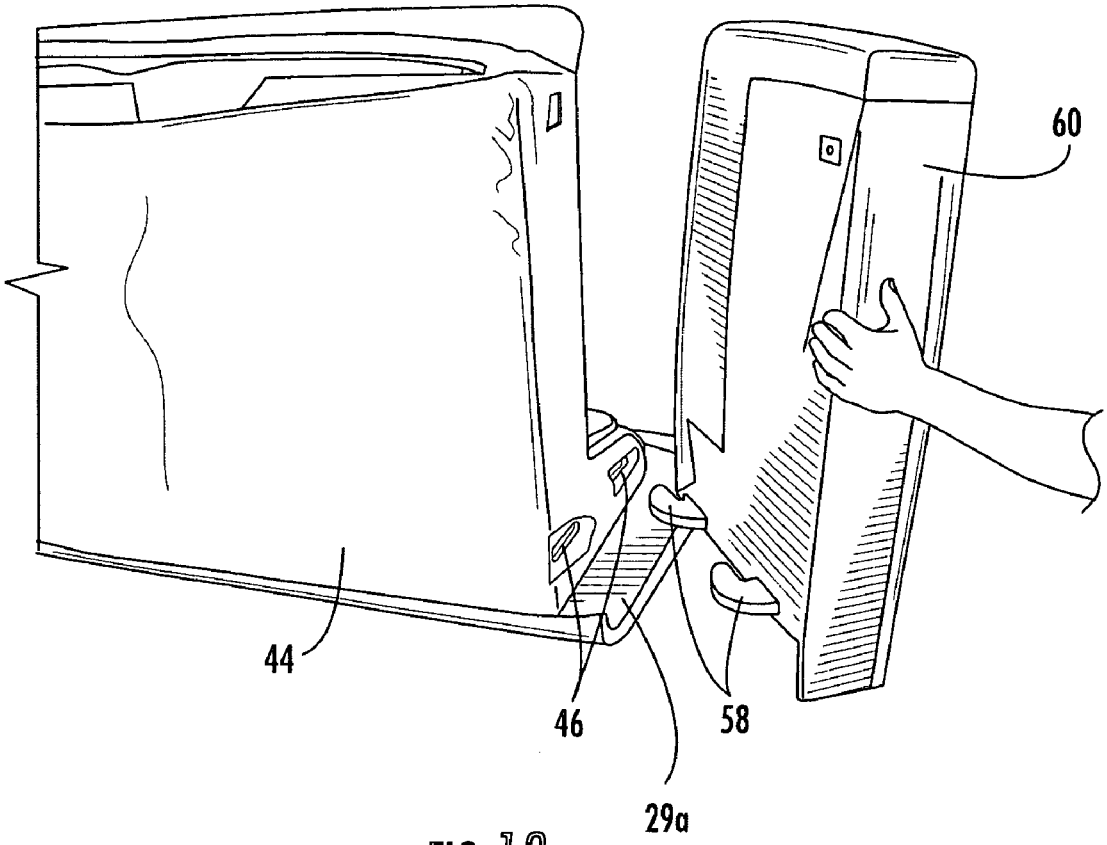
FIG. 13 is a bottom perspective view of the assembly of a fully upholstered arm unit of FIG. 12 to the fully upholstered back-deck unit of FIG. 8.
Figure 14:
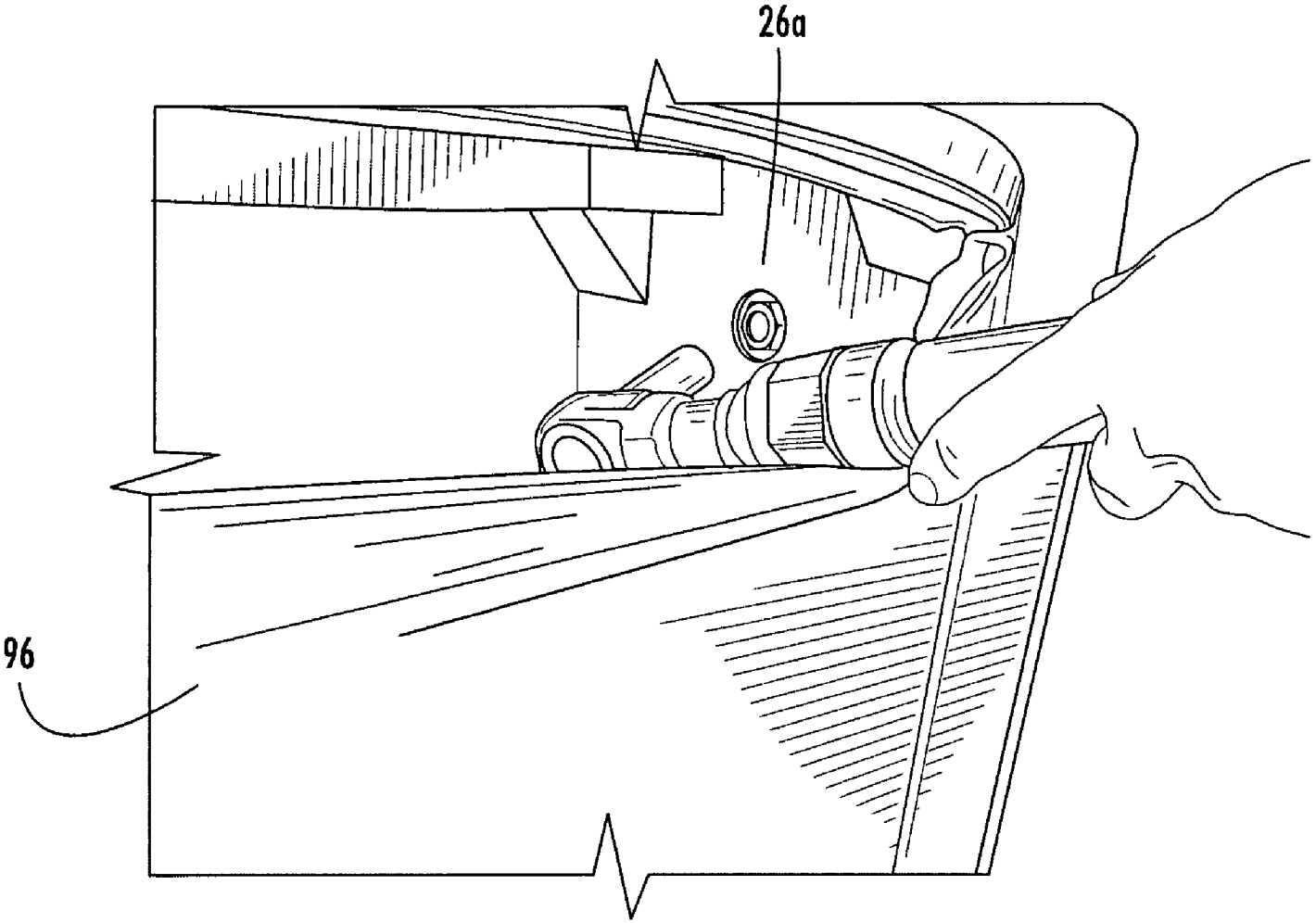
FIG. 14 is a greatly enlarged bottom perspective view of front portions of the arm unit and back-deck frame of FIG. 13 showing how the front portion of the arm unit is secured with a threaded fastener to the front portion of the back-deck frame.

Referring now to FIGS. 13 and 14, once the upholstered arm units 60 have been completed, they can be attached to the upholstered back-deck unit 44. The upholstered arm units 60 are interconnected with the upholstered back-deck unit 44 by first inserting the hooks 58 into the receptacles 46 in the back-deck frame 22 (see FIG. 13). Engagement of the hooks 58 with the receptacles 46 places the rear surface of the upholstered arm unit 60 in contact with and in front of the forward surface of the flange 29*a*. A threaded fastener (for example, a bolt) can be inserted through the side board 26*a* and into a receiving aperture in the gusset 50*g*. Access to the side board 26*a* is available via the zipper 98, which can be unzipped sufficiently to enable an operator to reach the side boards 26*a*, then re-zipped after the fastening operation is complete.

Referring now to FIG. 1, the feet 62 can be attached to the bottom surface of the bottom plank 50*b*. Positioning of the feet can be facilitated by the presence of the recesses 52. Also, the presence of the seam channels 53 can provide a relief area for the seam in the arm upholstery piece 54 that might otherwise interfere with flush mounting of the feet 62. This seam can be rather thick, particularly if a thick material such as leather is used with the upholstery, so reception of seams within the seam channels 53 can improve the precision of the mounting of the feet 53.

Those skilled in this art will appreciate that other finishing operations, such as additional stapling or fastening of components (for example, securing of the zipper slides), may also be desirable for the sofa 20. Typically, additional seat, armrest and/or backrest cushions will be employed with the sofa 20, although these may be omitted as desired. Also, additional ornamentation (such as studs, inlays, and the like) may also be included.

The sofa and manufacturing method of the present invention can offer some advantages over prior sofas. First, the separate upholstering of the back-deck frame and the arm frames can significantly simplify the upholstering process. The use of single upholstery pieces to substantially enclose the back-deck and arm frames can markedly reduce the amount of labor required to fully upholster these components. The use of a zipper or other reversible fastener to complete enclosure of the frame can further facilitate this process. Second, the inclusion of a dust cover that is integrated with the remainder of the back-deck upholstery eliminates the attachment of the dust cover as a separate step. Third, the use of slats and slots to mount the deck fabric taut on the frame can reduce labor considerably, particularly when the deck fabric is integrated with the remainder of the back-deck upholstery. Fourth, the inclusion of the hooks in the arm units can facilitate attachment of the arm units (particularly as they are already upholstered) and in embodiments in which the hooks extend upwardly, the weight of the back-deck unit and any occupants further secure the arm units in place. Fifth, the inclusion of the finger in front edge insert cushion enables it to be installed quickly. Sixth, the presence of the recesses on the arm units helps to align the feet, even if a thick upholstery material such as leather is used, and the presence of the seam channels within the recesses can enable the feet to fit flush against the recesses.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. As such, all such modifications are intended to be included within the scope of this invention. The scope of the invention is to be defined by the following claims.

That which is claimed is:

1. A backrest and deck subassembly for a sofa, comprising:

a frame having a generally horizontal deck section, the deck section including a top portion and an underlying bottom portion, the frame also having a generally upright backrest section attached to and extending upwardly from the deck section; and an integrated upholstery piece that covers the deck and backrest sections of the frame and underlies the bottom portion of the deck section;

wherein the upholstery piece includes a front panel portion and a dust cover portion, and wherein the dust cover portion underlies the deck section and is formed of a different material than the front panel portion.

2. The backrest and deck subassembly defined in claim 1, wherein the upholstery piece includes a zipper.

3. The backrest and deck subassembly defined in claim 2, wherein the zipper is positioned along a side panel.

4. The backrest and deck subassembly defined in claim 2, wherein the upholstery piece includes lateral panels that overlie lateral surfaces of the frame, and wherein the lateral panels include windows that permit access to recesses in the lateral surfaces.

5. The backrest and deck subassembly defined in claim 1, wherein the upholstery piece includes a backrest/deck portion that is formed of leather.

6. The backrest and deck subassembly defined in claim 1, wherein the upholstery piece is attached to the frame without staples.

7. The backrest and deck subassembly defined in claim 1, wherein the upholstery piece further includes a deck panel.

8. The backrest and deck subassembly defined in claim 7, wherein the deck panel includes laterally-extending pockets configured to receive elongate slats.

9. The backrest and deck subassembly defined in claim 8, wherein the deck top section includes laterally-extending slots, and wherein the elongate slats are received in the slots.

10. A backrest and deck subassembly for a sofa, comprising:

a frame having a generally horizontal deck section, the deck section including a top portion, the frame also having a generally upright backrest section attached to and extending upwardly from the deck section, the deck section top portion having front and rear laterally-extending slots;

a fabric deck panel; and a pair of slats attached to the deck panel, the slats being received in the front and rear slots of the deck section top portion;

further comprising an upholstery piece that covers the backrest and deck sections of the frame, and wherein the deck panel is attached to the upholstery piece.

11. The backrest and deck subassembly defined in claim 10, wherein the slats are separated from each other and the slots are spaced apart from each other such that the deck panel is taut when the slats are inserted into the slots.

12. The backrest and deck subassembly defined in claim 10, wherein the deck panel includes laterally-extending pockets, and wherein each slat is received in a respective pocket of the deck panel.

13. The backrest and deck subassembly defined in claim 10, wherein the front and rear slots are formed in the top portion of the deck section such that their upper ends flare away from one another.

14. A backrest and deck subassembly for a sofa, comprising:

a frame having a generally horizontal deck section, the deck section including a top portion and an underlying bottom portion, the frame also having a generally upright backrest section attached to and extending upwardly from the deck section; and an integrated upholstery piece that covers the deck and backrest sections of the frame and underlies the bottom portion of the deck section;

wherein the upholstery piece includes a front panel portion and a dust cover portion, and wherein the dust cover portion underlies the deck section and is formed of a different material than the front panel portion; and wherein the upholstery piece includes lateral panels that overlie lateral surfaces of the frame, and wherein the lateral panels include windows that permit access to recesses in the lateral surfaces.

* * * * *